US007490910B1

(12) United States Patent
Draughon

(10) Patent No.: US 7,490,910 B1
(45) Date of Patent: Feb. 17, 2009

(54) ADJUSTABLE PNEUMATIC ARMREST FOR A CHAIR

(76) Inventor: Roman Draughon, 1702 Alexander Ct., Sheboygan, WI (US) 53081

( * ) Notice: Subject to any disclaimer, the term of this patent is extended or adjusted under 35 U.S.C. 154(b) by 0 days.

(21) Appl. No.: 11/840,632

(22) Filed: Aug. 17, 2007

(51) Int. Cl.
*B60N 2/46* (2006.01)

(52) U.S. Cl. ..... 297/411.35; 297/411.31; 297/411.36

(58) Field of Classification Search ..... 297/411.36, 297/411.37, 411.38, 411.35, 411.2, 115, 297/116, 411.31; 29/428
See application file for complete search history.

(56) References Cited

U.S. PATENT DOCUMENTS 5,752,683 A * 5/1998 Novis et al. ..... 248/118
5,908,221 A 6/1999 Neil
5,931,536 A 8/1999 Wu
6,095,598 A * 8/2000 Piretti ..... 297/115
6,142,570 A * 11/2000 Bergsten et al. ..... 297/411.35
6,702,386 B2 3/2004 Davis et al.
7,055,910 B2 * 6/2006 Wright ..... 297/411.35
2004/0239170 A1 * 12/2004 Wang ..... 297/411.36

* cited by examiner

*Primary Examiner*—Milton Nelson, Jr.
(74) *Attorney, Agent, or Firm*—Ziolkowski Patent Solutions Group, SC

(57) ABSTRACT

An apparatus and method for providing an adjustable armrest. The adjustable armrest includes a horizontal armrest support, a fixed rear armpad and a slideable front armpad able to translate along the horizontal armrest support in a lengthwise direction. The adjustable armrest also includes a vertical member connected to the horizontal armrest support to bear the horizontal armrest support. The vertical member includes a gas-charged piston to vertically adjust a height of the horizontal armrest support. On the vertical member is a manually operated control used to actuate the gas-charged piston to vertically adjust a height of the horizontal armrest support. Additionally, the horizontal armrest support is configured to pivot around a connection point to the gas-charged piston.

20 Claims, 5 Drawing Sheets

ADJUSTABLE PNEUMATIC ARMREST FOR A CHAIR

BACKGROUND OF THE INVENTION

The present invention relates to an improved armrest for a chair that is horizontally and vertically adjustable. More particularly, the present invention is directed to an adjustable armrest that is horizontally extendable, pivotable in a horizontal plane, and vertically adjustable via a control and pneumatic piston.

Chairs have been designed and manufactured in various ways to meet the many needs of consumers and to suit numerous different settings and situations. There are many different categories of chairs including rocking chairs, office chairs, swivel chairs, folding chairs, lawn chairs, etc. One main goal in chair design and manufacture is comfort for a user. An armrest is of utmost importance in a user's determination of the comfort level of a chair. Generally, armrests are in fixed positions relative to the seating portion of the chair, which can cause discomfort and other problems for users that do not fit the fixed position of the chair and armrest.

In an office environment, where workers often are seated at a desk and working with computers or other electronic systems for extended periods of time, a well designed office chair can maximize comfort and efficiency. More specifically, an adjustable armrest on such an office chair can be of great importance to a worker who is performing a variety of computer related functions, such as typing, scrolling and moving a mouse, sorting through paperwork, or performing other typical office tasks. A versatile arm rest can make such tasks easier and can cut down on worker fatigue and discomfort.

While office chairs in the prior art have been designed and constructed to include adjustable armrests, such armrests are often limited in their adjustability, and the means to achieve the adjustments are not ideal. For instance, some prior art armrests have only one or two methods of adjustment, such as vertical or pivotal adjustability. These armrests lack additional modes of adjustment that can further maximize worker efficiency and comfort. Additionally, the mechanisms for adjusting the armrest can be limiting. For instance, the vertical adjustability of an armrest can be limited to only a number of pre-selected vertical positions at which the armrest locks into place. Additionally, some prior art armrests include a horizontal member that can slide horizontally; however, in existing designs, the entirety of the horizontal member is slid to another position. Such a design does not adjust the armrest in such a way as to accommodate users with different size forearms, as the length of the armrest does not change.

In light of the above limitations inherent to current armrest designs, a need exists for an armrest that covers all needed modes of adjustment that a user might desire in an office or other setting and convenient mechanisms for implementing these adjustments. It would therefore be desirable to have a system and method capable of achieving greater armrest adjustability with improved mechanisms for making adjustments to the armrest position.

BRIEF DESCRIPTION OF THE INVENTION

The present invention overcomes the aforementioned problems by providing a pneumatic armrest for a chair having a plurality of adjustment mechanisms.

According to one aspect of the present invention, an adjustable armrest for a chair includes a horizontal armrest support, a rear armpad assembly fixedly connected to the horizontal armrest support, and a front armpad assembly positioned adjacent to the rear armpad assembly and configured to translate along the horizontal armrest support in a lengthwise direction. Also, the adjustable armrest includes a vertical member connected to the horizontal armrest support to bear the horizontal armrest support. The vertical member includes a gas-charged piston to vertically adjust a height of the horizontal armrest support. On the vertical member is a manually operated control used to actuate the gas-charged piston to vertically adjust a height of the horizontal armrest support. Additionally, the horizontal armrest support is configured to pivot around a connection point to the gas-charged piston.

In accordance with another aspect of the invention, a chair includes a backrest portion, a seating portion, and an adjustable armrest. The adjustable armrest includes a pneumatic cylinder assembly affixed to the seating portion, a horizontal member, a rotation mechanism, and a push-button control. The horizontal member is mounted on the pneumatic cylinder assembly and includes a track, a fixed top surface portion, and a slideable top surface portion. The fixed top surface portion is fixedly mounted to the track and the slideable top surface portion is configured to slide along the track. The rotation mechanism is positioned between the horizontal member and the pneumatic cylinder assembly and is configured to rotate the horizontal member about the pneumatic cylinder assembly. Also, the push-button control is configured to control the pneumatic cylinder assembly to vertically adjust the horizontal member.

In accordance with another aspect of the invention, a method of manufacturing an adjustable armrest includes the step of constructing a horizontal member having a fixed member and a slideable member. The slideable member is configured to extend horizontally from the fixed member to increase the length of the horizontal member. Also, the method includes the step of constructing a vertical member having a gas-charged piston that, when activated, is configured to cause the horizontal member to be vertically adjusted. Additionally, the method includes a step of pivotably mounting the horizontal member on the vertical member so that the vertical member is supporting the horizontal member and the horizontal member can horizontally pivot about the vertical member.

Various other features and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

As will be described in greater detail below, the present invention is directed to an adjustable armrest that is horizontally extendable and pivotable and is vertically adjustable via a manually operated control and pneumatic piston.

Figure 1:
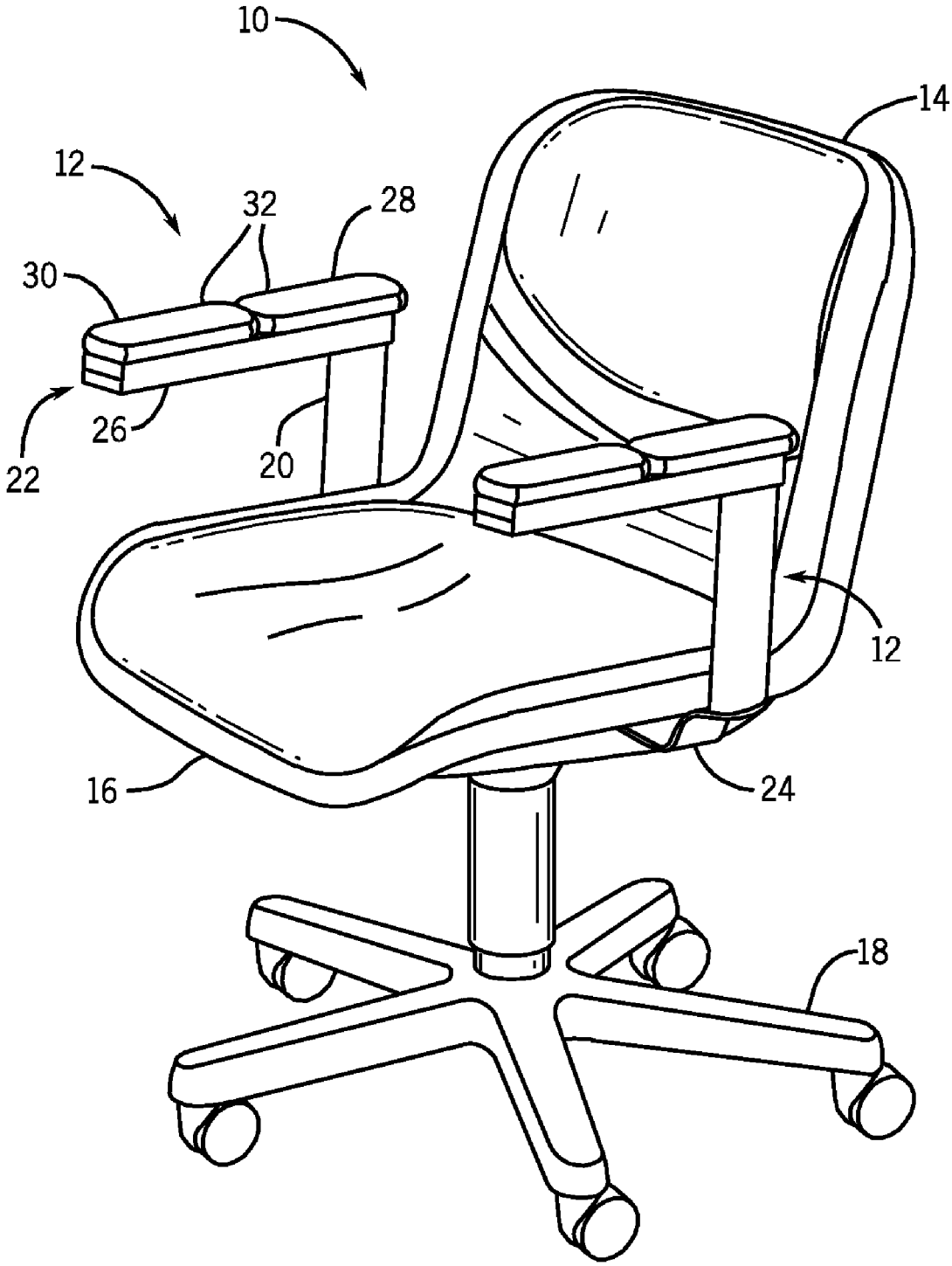
FIG. 1 is a perspective view of an office-type chair with adjustable armrests according to an embodiment of the present invention.

Referring to FIG. 1, an exemplary office-type chair 10 is shown with a novel adjustable armrest 12. In addition to the adjustable armrest 12, office chair 10 includes a backrest portion 14, a seating portion 16, and a chair base 18 with wheels. The adjustable armrest 12 is made up of a vertical member 20 and a horizontal member 22, with horizontal member 22 being mounted on, and supported by, vertical member 20. Vertical member 20 is in turn connected to a supporting member 24, for securing adjustable armrest 12 to seating portion 16.

The horizontal member 22 further comprises a horizontal armrest support 26, a fixed rear armpad assembly 28 (i.e., fixed top surface portion), and a slideable front armpad assembly 30 (i.e., slideable top surface portion). Both the fixed rear armpad assembly 28 and the slideable front armpad assembly 30 include an armpad 32. The armpads 32 included in fixed rear armpad assembly 28 and slideable front armpad assembly 30 are identical. Thus, during construction of adjustable armrest 12, armpads 32 can be interchangeably used in constructing either the fixed or slideable armrest assembly 28, 30. However, as will be described below, additional mechanisms are included in fixed rear armpad assembly 28 and slideable front armpad assembly 30 and the method of coupling each armpad assembly 28, 30 to horizontal armrest support 26 is distinct.

Figure 2:
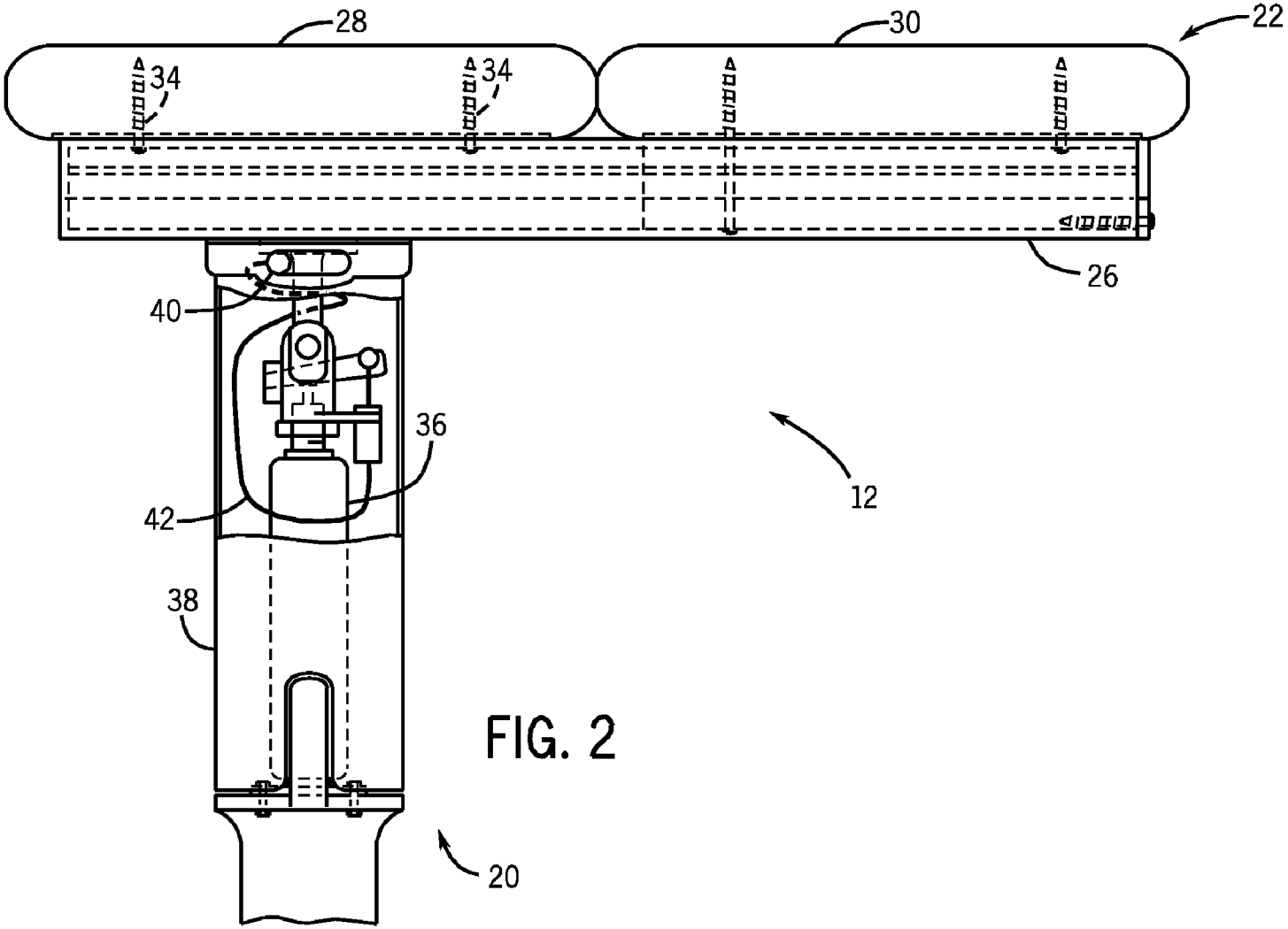
FIG. 2 is a side cross-sectional view of the adjustable armrest of FIG. 1.

Turning to FIG. 2, a side cross-sectional view of adjustable armrest 12 is shown. Fixed rear armpad assembly 28 and slideable front armpad assembly 30 are positioned on horizontal armrest support 26 to form horizontal member 22. As shown in FIG. 2, horizontal armrest support 26 is configured as a track bar. Fixed rear armpad assembly 28 is fixedly connected to a back portion of track bar 26 by way of screws 34 and is positioned generally above vertical member 20. Slideable front armpad assembly 30 is also positioned on track bar 26 and is connected thereto in a manner that allows front armpad assembly 30 to slide within track bar 26 to extend the length of horizontal member 22. As shown in FIG. 2, horizontal member 22 is in a non-extended position and slideable front armpad assembly 30 is positioned immediately adjacent to fixed rear armpad assembly 28; however, as will be explained below, slideable front armpad assembly 30 can also slide in a lengthwise direction relative to the horizontal member in a direction away from fixed rear armpad assembly 28.

Referring still to FIG. 2, vertical member 20 includes a pneumatic cylinder assembly (i.e., gas-charged piston) 36 that is surrounded by an outer housing 38. When activated, gas-charged piston 36 causes an upward force that can vertically extend vertical member 20 and cause the horizontal member 22 to be raised to a desired height. As pictured, gas-charged piston 36 is in a non-extended state; however, a control 40 positioned on vertical member 20 allows a user to activate and extend piston 36. A cable/hose 42 extends from piston 36 to control 40 to transfer compressed air or gas upon activation of gas-charged piston 36 by controller 40. The gas-charged piston 36 and cable 42 are enclosed within outer housing 38.

Figure 3:
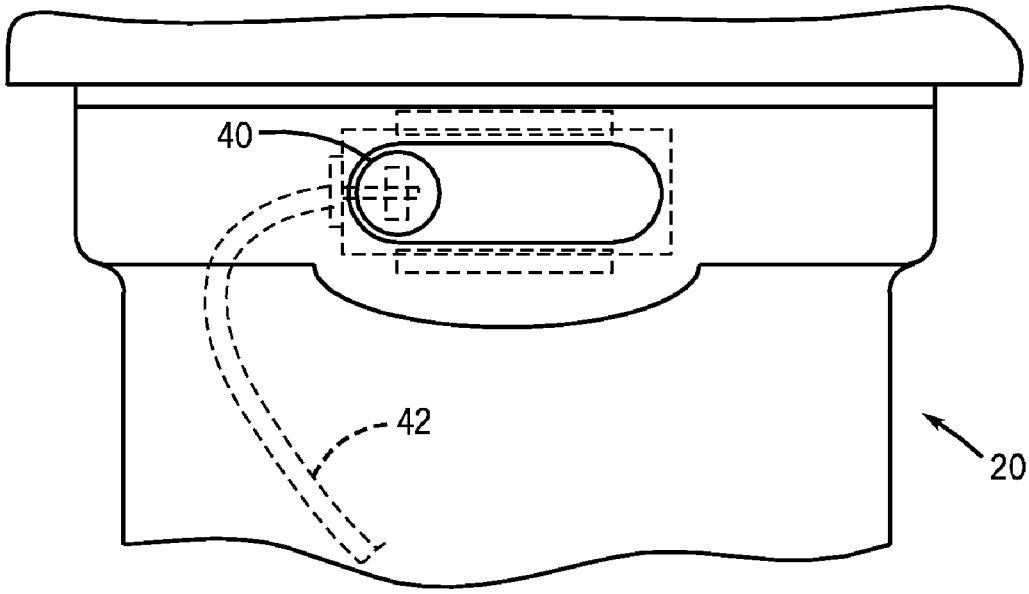
FIG. 3 is a side cross-sectional view of a push-button control in a non-activated state according to an embodiment of the present invention.
Figure 4:
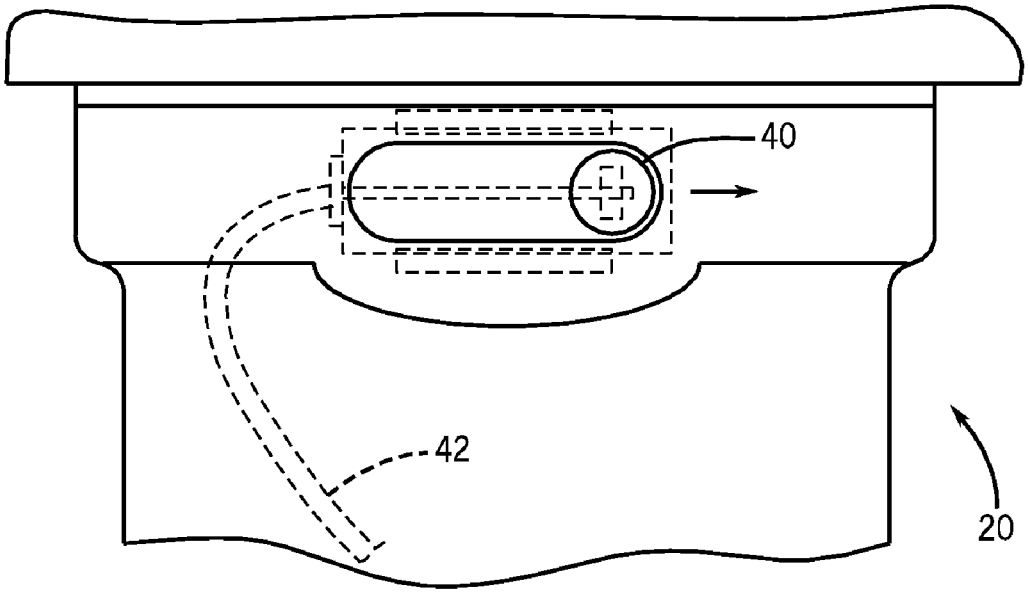
FIG. 4 is a side cross-sectional view of the push-button control in an activated state according to an embodiment of the present invention.

As shown in FIGS. 3 and 4, in one embodiment control 40 is a push-button control that is activated when a user manually slides the button forward. FIG. 3 shows push-button control 40 in its default, non-activated position. When desired, push-button control 40 can be pressed and slid forward by a user, as shown in FIG. 4, to move the push-button control 40 to an activated position. Referring again to FIG. 2, when push-button control 40 is in its non-activated position, gas-charged piston 36 remains in a fixed position and horizontal member 22 is retained at a current height. However, when push-button control 40 is in its activated position, pneumatic cylinder assembly 36 is activated to exert an upward force on horizontal member 22. When the upward force of the pneumatic piston 36 is greater than any downward forces applied to the horizontal member 22 by a user, horizontal member 22 raises. When a downward force is applied to horizontal member 22 by a user that is greater than an upward force provided by the pneumatic piston 36, the horizontal member 22 lowers. While push-button control 40 has been described as a push-button mechanism that is pressed and slid forward by a user, it is also envisioned that the control 40 can be a simple push-button that is activated when depressed inward.

Figure 5:
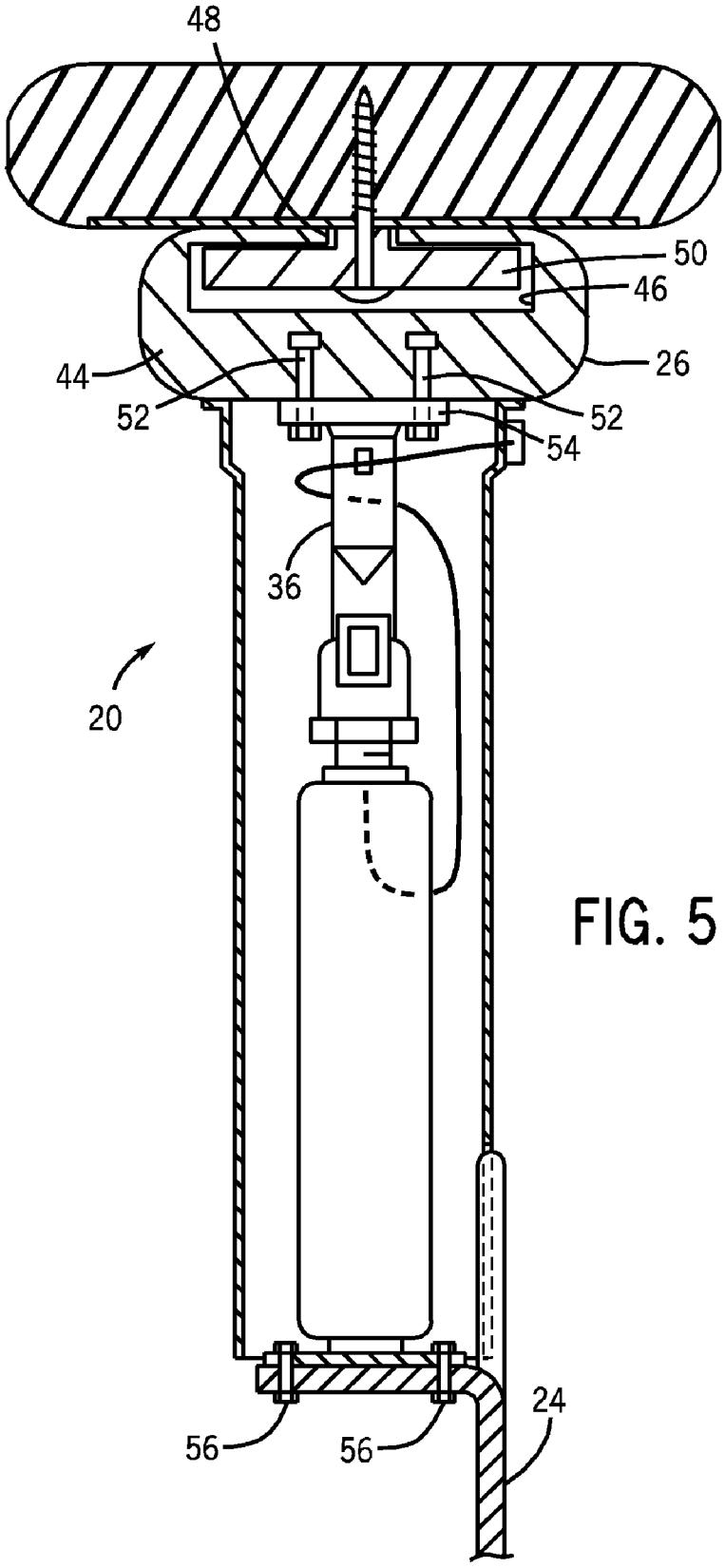
FIG. 5 is a front cross-sectional view of the adjustable armrest of FIG. 1.

Referring now to FIG. 5, a front view of the adjustable armrest 12 is shown. Track bar 26 in adjustable armrest 12 can be seen as comprising an outer shell 44, a hollow interior 46 within the outer shell 44, and a channel 48 formed on a top surface of outer shell 44 that runs the length of the track bar 26. Attached to an underside of the front armpad assembly 30 is an upside-down T-shaped member 50, which mates with the hollow interior 46 of track bar 26 and slides within channel 48 and hollow interior 46. T-shaped member 50 enables front armpad assembly 10 to be secured to track bar 26, yet maintain the ability to slide forward and backward along the track bar to adjust the length of horizontal member 22.

Also shown in FIG. 5, top mounting bolts 52 join pneumatic piston 36 to a rotating connection mechanism 54 and horizontal armrest support 26. Rotating connection mechanism 54 serves as a connection point between horizontal member 22 and vertical member 20 and allows for rotation of the horizontal member 22 about the vertical member 20. Bottom mounting bolts 56 are also included in adjustable armrest 12 to connect vertical member 20 to supporting member 24, which is mounted on seating portion 16 (see FIG. 1). Although bolts 52, 56 are used to mount components of the adjustable armrest 12, it is envisioned that any similarly functioning mounting devices known to those of ordinary skill in the art, such as screws, can be used in their place.

Figure 6:
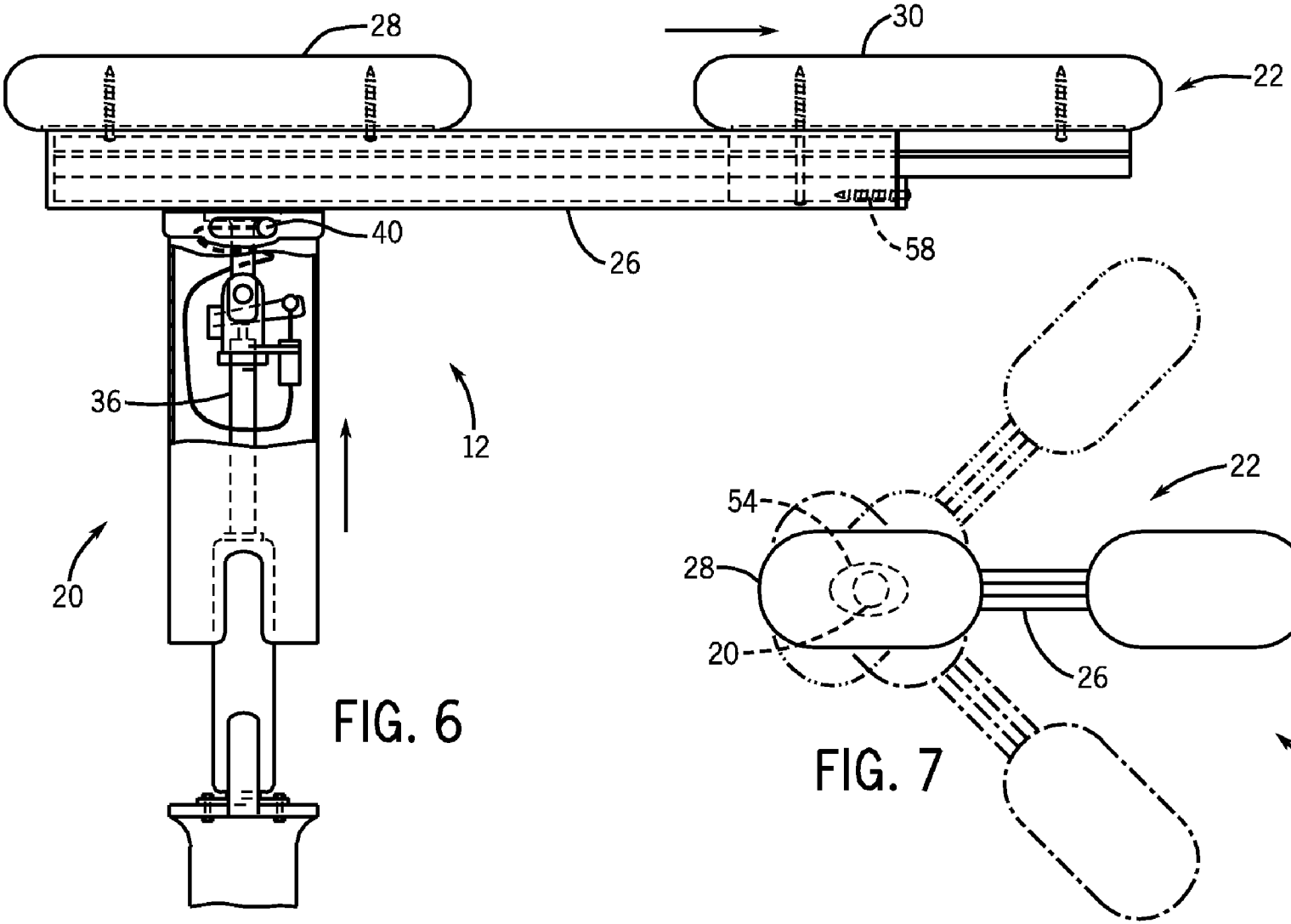
FIG. 6 is a side cross-sectional view of the adjustable armrest of FIG. 1 with extended vertical and horizontal members.

Turning now to FIG. 6, adjustable arm 12 is shown in an extended state in both a vertical direction and a horizontal direction. That is, vertical member 20 is extended vertically by way of gas-charged cylinder 36 having been activated by push-button control 40. Additionally, slideable front armpad assembly 30 has been moved forward along track bar 26, thus extending the length of horizontal member 22. Furthermore, being able to vertically adjust horizontal member 22 allows a user to choose a desired height at which to rest the user's arm for maximum comfort. Extending the overall length of horizontal member 22 by moving slideable front armpad assembly 30 forward, while the rear armpad assembly 28 remains fixed, advantageously enables adjustable armrest 12 to accommodate various forearm sizes. In other words, users may have different elbow-to-wrist lengths that ordinarily could not be accommodated by a fixed armrest or by an armrest that slides in its entirety; however, the ability to slide front armpad assembly 30 ensures that users with a longer distance between elbow and wrist can still rest both elbow and wrist on adjustable armrest 12. To set a maximum distance at which front armpad assembly 30 can be translated from rear armpad assembly 28, a stop plug 58 is positioned at the end of track bar 26. Stop plug 58 prevents T-shaped member 50 from sliding past an end point of track bar 26. Stop plug 58 can take the form of a bolt, pin, screw, or any other device that can easily be secured to track bar 26 and extend into hollow interior 46 to abut t-shaped member 50 when slid forward.

Figure 7:
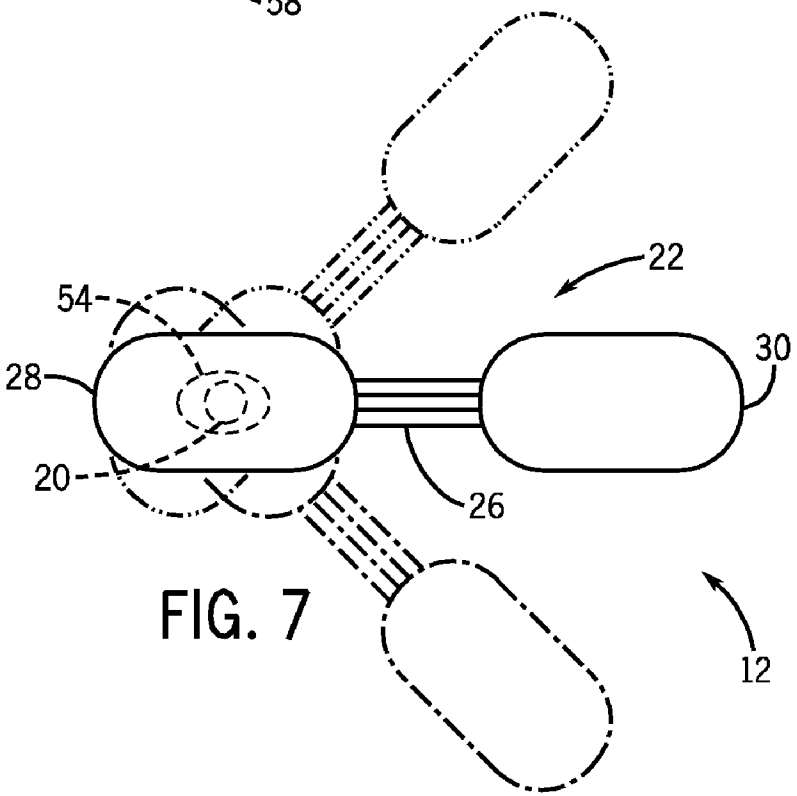
FIG. 7 is an overhead view of the adjustable armrest of FIG. 1 being rotated clockwise and counter-clockwise.

Referring now to FIG. 7, the angular range of motion of horizontal member 22 in pivoting about vertical member 20 in the horizontal plane is shown. Horizontal member 22 is connected to vertical member 20 so that it can be pivoted about the connection point therebetween, in either a clockwise or counter-clockwise direction. That is, to allow for pivoting at the connection point, rotating connection mechanism 54 is positioned to secure horizontal member 22 with vertical member 20. Rotation of horizontal member 22 in both a clockwise and counter-clockwise direction allows a user to choose a desired position for comfort and allows the user to easily move from, for example, a keyboard to a mouse, without having to lift their arm from adjustable armrest 12. As such, rotating connection mechanism 54 is configured to allow for rotation of the horizontal member 22 over an angular range of at least 45 degrees to maximize user comfort.

While the adjustable armrest 12 set forth above has been described for use with an office-type chair 10 as shown in FIG. 1, it is envisioned that adjustable armrest 12 can be mounted to any suitable chair.

Therefore, according to one embodiment of the present invention, an adjustable armrest for a chair includes a horizontal armrest support, a rear armpad assembly fixedly connected to the horizontal armrest support, and a front armpad assembly positioned adjacent to the rear armpad assembly and configured to translate along the horizontal armrest support in a lengthwise direction. Also, the adjustable armrest includes a vertical member connected to the horizontal armrest support to bear the horizontal armrest support. The vertical member includes a gas-charged piston to vertically adjust a height of the horizontal armrest support. On the vertical member is a manually operated control used to actuate the gas-charged piston to vertically adjust a height of the horizontal armrest support. Additionally, the horizontal armrest support is configured to pivot around a connection point to the gas-charged piston.

In accordance with another embodiment of the invention, a chair includes a backrest portion, a seating portion, and an adjustable armrest. The adjustable armrest includes a pneumatic cylinder assembly affixed to the seating portion, a horizontal member, a rotation mechanism, and a push-button control. The horizontal member is mounted on the pneumatic cylinder assembly and includes a track, a fixed top surface portion, and a slideable top surface portion. The fixed top surface portion is fixedly mounted to the track and the slideable top surface portion is configured to slide along the track. The rotation mechanism is positioned between the horizontal member and the pneumatic cylinder assembly and is configured to rotate the horizontal member about the pneumatic cylinder assembly. Also, the push-button control configured to control the pneumatic cylinder assembly to vertically adjust the horizontal member.

In accordance with another embodiment of the invention, a method of manufacturing an adjustable armrest includes the step of constructing a horizontal member having a fixed member and a slideable member. The slideable member is configured to extend horizontally from the fixed member to increase the length of the horizontal member. Also, the method includes a step of constructing a vertical member having a gas-charged piston that, when activated, is configured to cause the horizontal member to be vertically adjusted. Additionally, the method includes a step of pivotably mounting the horizontal member on the vertical member so that the vertical member is supporting the horizontal member and the horizontal member can horizontally pivot about the vertical member.

The present invention has been described in terms of the preferred embodiment, and it is recognized that equivalents, alternatives, and modifications, aside from those expressly stated, are possible and within the scope of the appending claims.

What is claimed is:

1. An adjustable armrest for a chair comprising:

a horizontal armrest support;

a rear armpad assembly fixedly connected to the horizontal armrest support;

a front armpad assembly positioned adjacent to the rear armpad assembly and configured to translate along the horizontal armrest support in a lengthwise direction;

a vertical member connected to the horizontal armrest support to bear the horizontal armrest support, the vertical member including a gas-charged piston to vertically adjust a height of the horizontal armrest support;

a manually operated control positioned on the vertical member to actuate the gas-charged piston to vertically adjust a height of the horizontal armrest support; and wherein the horizontal armrest support is configured to pivot around a connection point to the gas-charged piston.

2. The adjustable armrest of claim 1 wherein the horizontal armrest support further comprises a track bar having an outer shell, a hollow interior within the outer shell, and a channel formed in a top surface of the outer shell running the length of the track bar.

3. The adjustable armrest of claim 2 wherein the gas-charged piston is attached to a bottom surface of the track bar.

4. The adjustable armrest of claim 2 wherein the front armpad assembly further comprises a t-shaped member configured to mate with the hollow interior of the track bar and slide within the channel and hollow interior of the track bar.

5. The adjustable armrest of claim 2 wherein the front armpad assembly is further configured to slide along the track bar relative to the rear armpad assembly to increase the length of the horizontal armrest support to a length at least sufficient to support a forearm of a user from elbow to wrist.

6. The adjustable armrest of claim 2 wherein the track bar further comprises a stop plug to prevent the front armpad assembly from sliding past an endpoint of the track bar.

7. The adjustable armrest of claim 1 wherein the connection point further comprises a rotation mechanism positioned between the horizontal armrest support and the vertical member and configured to allow for rotation of the horizontal armrest support about the vertical member.

8. The adjustable armrest of claim 1 wherein the manually operated control further comprises a push-button control, the push-button control configured to actuate the gas-charged piston and vertically translate the horizontal armrest support when pressed and prevent actuation of the gas-charged piston when released.

9. The adjustable armrest of claim 8 wherein the gas-charged piston is configured so that when the push-button control is pressed and a downward force is applied to the horizontal armrest support that is greater than an upward force provided by the gas-charged piston, the horizontal armrest support lowers.

10. A chair comprising:

a backrest portion;

a seating portion; and an adjustable armrest, wherein the adjustable armrest comprises:

a pneumatic cylinder assembly affixed to the seating portion;

a horizontal member mounted on the pneumatic cylinder assembly and including a track, a fixed top surface portion, and a slideable top surface portion, wherein the fixed top surface portion is fixedly mounted to the track and the slideable top surface portion is configured to slide along the track;

a rotation mechanism positioned between the horizontal member and the pneumatic cylinder assembly and configured to rotate the horizontal member about the pneumatic cylinder assembly; and a push-button control configured to control the pneumatic cylinder assembly to vertically adjust the horizontal member;

wherein the slideable top surface portion and the fixed top surface portion comprise a slideable armpad assembly and a fixed armpad assembly respectively, and wherein the slideable armpad assembly is configured to slide within the track to modify a distance between the slideable armpad assembly and the fixed armpad assembly and modify a length of the horizontal member.

11. The chair of claim 10 wherein the push-button control is configured to activate the pneumatic cylinder assembly to raise or lower the horizontal member when depressed and fix a position of the pneumatic cylinder assembly to maintain the horizontal member at a current height when not depressed.

12. The chair of claim 10 wherein the rotation mechanism is configured to allow the horizontal member to rotate about the pneumatic cylinder assembly in a clockwise and a counter-clockwise direction.

13. The chair of claim 10 wherein the horizontal member has a range of rotation about the pneumatic cylinder assembly of at least 45 degrees.

14. The chair of claim 10 wherein the track includes a stop plug to prevent the slideable top surface portion from sliding past an endpoint of the track.

15. The chair of claim 10 wherein the slideable top surface portion is at a greater distance from the rotation mechanism than the fixed top surface portion.

16. A method of manufacturing an adjustable armrest comprising the steps of:

constructing a horizontal member having a fixed member and a slideable member, wherein the slideable member is configured to extend horizontally from the fixed member to increase the length of the horizontal member;

constructing a vertical member having a gas-charged piston that, when activated, is configured to cause the horizontal member to be vertically adjusted; and pivotably mounting the horizontal member on the vertical member so that the vertical member is supporting the horizontal member and the horizontal member can horizontally pivot about the vertical member;

wherein the step of constructing the horizontal member further comprises:

forming a track bar having an outer shell, a hollow interior within the outer shell, and a channel formed in a top surface of the outer shell running the length of the track bar;

screwing the fixed member to the track bar;

mounting a t-shaped member on the slideable member;

positioning the t-shaped member within the hollow interior and channel of the track bar to slidingly engage the slideable member with the track bar.

17. A method of manufacturing an adjustable armrest comprising the steps of:

constructing a horizontal member having a fixed member and a slideable member, wherein the slideable member is configured to extend horizontally from the fixed member to increase the length of the horizontal member;

constructing a vertical member having a gas-charged piston that, when activated, is configured to cause the horizontal member to be vertically adjusted; and pivotably mounting the horizontal member on the vertical member so that the vertical member is supporting the horizontal member and the horizontal member can horizontally pivot about the vertical member;

wherein constructing the horizontal member further comprises constructing a pair of armpads, wherein each of the pair of armpads is configured to at least partially form one of the fixed member and the slideable member.

18. The method of claim 17 wherein the step of constructing the horizontal member further comprises:

forming a track bar having an outer shell, a hollow interior within the outer shell, and a channel formed in a top surface of the outer shell running the length of the track bar;

screwing the fixed member to the track bar;

mounting a t-shaped member on the slideable member;

positioning the t-shaped member within the hollow interior and channel of the track bar to slidingly engage the slideable member with the track bar.

19. The method of claim 17 further comprising the step of mounting a push-button control on the vertical member, the push-button control configured to actuate the gas-charged piston and vertically translate the horizontal member when pressed and prevent actuation of the gas-charged piston when released.

20. The method of claim 17 wherein the step of pivotably mounting further comprises positioning a rotation mechanism between the horizontal member and the vertical member to rotate the horizontal member about the vertical member.

* * * * *